United States Patent [19]

Yeh

[11] 4,165,614

[45] Aug. 28, 1979

[54] SELF-CONTAINED VAPOR-POWER PLANT REQUIRING A SINGLE MOVING-PART

[76] Inventor: George C. Yeh, Smedley Dr., R.D. #1, Newton Square, Pa. 19073

[21] Appl. No.: 337,084

[22] Filed: Mar. 1, 1973

[51] Int. Cl.[2] ..... F01K 11/02; F01K 21/00

[52] U.S. Cl. ..... 60/531; 60/670; 60/669; 165/105

[58] Field of Search ..... 60/531, 669, 670, 671, 60/650, 651; 165/105

[56] References Cited

U.S. PATENT DOCUMENTS 3,670,495 6/1972 Leffert ..... 60/531

*Primary Examiner*—Allen M. Ostrager

*Attorney, Agent, or Firm*—James Albert Drobile

[57] ABSTRACT

A simple vapor-power plant, completely self-contained in an enclosed space, whose working fluid executes, in a truly continuous fashion, a complete cyclic operation involving at least vaporization, expansion, condensation and recycling of itself by flowing steadily through a closed loop of continuous space consisting of several distinct funcational zones within a capillary (or porous) structure and an adjacent opened space, while converting the work of expansion into the corresponding mechanical work by a free-rotating turbine situated inside said opened space; said turbine being the only required basic moving-part of said vapor-power plant.

3 Claims, 3 Drawing Figures

SELF-CONTAINED VAPOR-POWER PLANT REQUIRING A SINGLE MOVING-PART

Figure 1A:
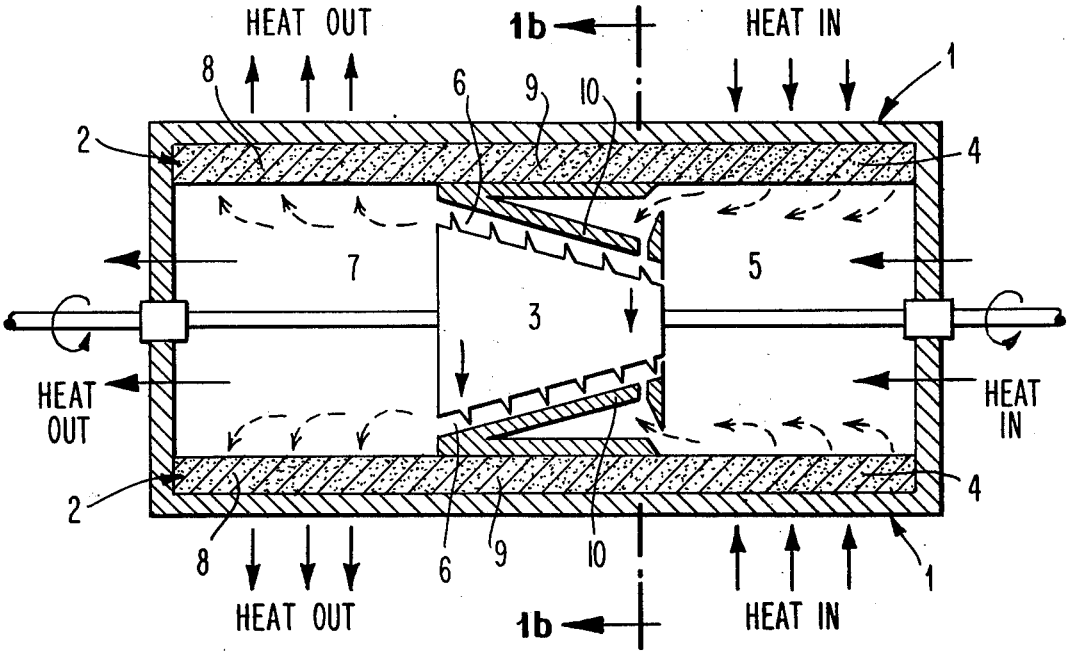

This invention relates to vapor-power plants. It is particularly concerned with a vapor-power plant that works completely within an enclosed space throughout the entire cycle, with a single basic moving-part—a free-rotating turbine, according to a completely revolutionary working concept.

A vapor engine is a cyclically operating system across whose boundaries flow only heat and work, and has, as its primary purpose, the conversion of heat into work. In a vapor engine, the working fluid, while undergoing a series of processes, periodically returns to its initial state. For example, in a steam engine, the working fluid, water, flows steadily through the boiler, turbine, condenser, and feed-pump, executing a cycle. It is well-understood that while the thermodynamic efficiency of a vapor engine depends on the operating temperature and pressure, the actual overall operating efficiency and economy are always determined and limited by the efficiency and economy of each of the component processes and of the equipments, which are integral parts of the whole vapor-power plant. Furthermore, for a vapor-power plant to work steadily and smoothly, each of its component processes and auxiliary equipments must function steadily and smoothly. Because of the mechanical complexity and the necessary space associated with these component processes and equipments, the conventional vapor-power plant has not been widely adopted as a power-plant for highly mobile vehicles, residential uses and other applications requiring portability and simple maintenance. Unlike internal combustion engines which produce toxic gases and cause unsightly smog, vapor engines use external combustion—a process which allows complete combustion of the fuel without violent detonation—emit only carbon dioxide and water vapor which are invisible, harmless gases, causing no pollution to air and excessive noises.

It is a main object of the present invention to provide a self-contained vapor-power plant that requires a single basic moving-part; and therefore is simple in design and construction, trouble-free in operation, and high in efficiency for a very wide range of the operating temperature and pressure. To accomplish the above object, all the component processes of the cyclic operation are carried out inside a single device in a truly continuous fashion by letting the working fluid flow steadily through several functional zones and execute specific component processes at specific zones, utilizing specific physico-chemical and fluidynamic properties of the working fluid at said specific zones inside said device as will be described below in detail. As a result, the vapor-power plant provided by the present invention may have all the advantages of the external combustion engines over the internal combustion engines but does not have the mechanical complexity and low efficiency that are usually associated with all the known vapor-power plants.

Another main object of the present invention is to provide a vapor-power plant whose operating efficiency depends very little on a gravity force—a feature unusual to any conventional vapor-power plants—, and may be unlimited by its size; and therefore it may be adopted as a power plant or energy converter in those situations in which all the conventional vapor-power plants fail to produce desirable results. A few examples of foreseeable applications of the present invention are: stationary and portable electrical power plants; process-plant drivers; suppliers for industrial machines; power plants for automobiles, rail-road trains, aircrafts, ships, submarines, time-machines, gyrographs, gyroscopes; gyro-stabilizers; gravity-field generators, etc.

Figure 1B:
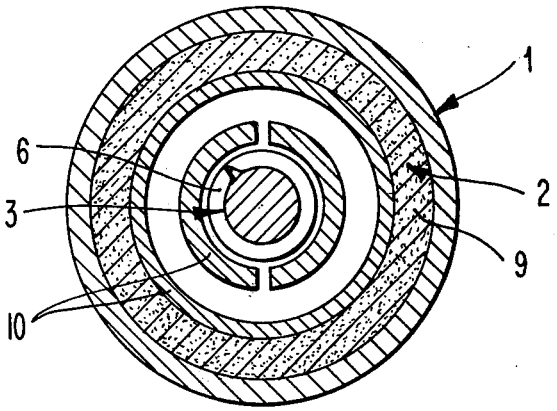

The vapor-power plant provided by the present invention is revolutionary in its concepts and mechanisms by which the working fluid execute one component process after another and by which all the component processes interact with each other inside the vapor-power plant. Its basic working concept may be better illustrated by FIG. 1—Schematic Representation of Basic Working Concept. Referring to FIG. 1, the present invention consists basically of an enclosed space (or chamber) formed by wall (1) with its inner wall constructed of a layer of capillary (or porous) structure (2) made of a high-energy material capable of being completely wetted by the working fluid and of conducting heat to and/or from said working fluid. Said enclosed space (or chamber) has three distinct functional zones, namely; the vaporization zone (5), the expansion zone (6), and the condensation zone (7); and a free-rotating turbine (3) is situated between said vaporization zone (5) and said condensation zone (7). Said turbine is surrounded by the turbine-housing (10), which provides the passage (or passages) for the vapor generated into and supports the stationary nozzles; said nozzles being circularly distributed around said turbine and direct vapor jets on the blades (or buckets) mounted radially on the periphery of a rotating wheel, as shown. The wheel is propelled by the thrust resulting from the change in momentum accompanying the reversal of direction of the high-velocity vapor jets. Thus, the work of expansion is performed within the spaces between the blades in the expansion zone (6) by said vapor directed from said nozzles; and said work of expansion is converted into the corresponding shaft-work through said free-rotating turbine (3). Needless to say, multiple expansions may be obtained by use of several stages in series, with the exhaust from the blades of one stage flowing directly into the nozzles of the next; the wheels of all stages being mounted on a single shaft, and the nozzles of all stages are directed from and supported by the said turbine-housing (10). Said blades must be ideally designed and said nozzles be directed in the direction of motion of said blades to produce only a reversal in direction of the vapor-flow but no appreciable pressure drop, as may be well-understood by the workers in the field. Said capillary (or porous) structure (2) described above consists also of three distinct functional zones, namely: the heating zone (4) adjacent to said vaporization zone (5), the cooling zone (8) adjacent to said condensation zone (7), and the recycling zone (9) adjacent to said turbine-housing (10), which isolates said expansion zone (6) from said recycling zone (9). To start the vapor engine provided by the present invention, heat is added to the working fluid externally (and/or internally using a rotating-drum with a jacket on its periphery for circulating a heating medium, as will be described in the Examples following) in said heating zone (4). The heat added supplies the latent heat of vaporization to said working fluid (in liquid state) by conduction and convection through said porous structure (2) and force said liquid to vaporize into said vaporization zone (5), where the vapor may further be superheated by the internally added heat by the method mentioned above. As the pressure in said vaporization zone (5) rises, the vapor moves its way to the inner space (or pocket) of said turbine-housing (10) and then into said nozzles, from which it expands itself against the blades of said turbine (3), which convert the work of expansion into the corresponding shaft-work, as described above. The exhaust from said turbine is directed toward the inside surface of the cooling zone (8), where it is cooled and condensed by rejecting heat externally through the capillary (or porous) structure of said cooling zone (8) (and/or internally using a rotating-drum with a jacket on its periphery for circulating a cooling medium, as will be described in the Examples following). The condensate wetting the inside surface of said capillary (or porous) structure in said cooling zone (8) is drawn into the interior of said capillary (or porous) structure by the capillary suction pressure created at the liquid menisci near the inside surface of the capillary (or porous) structure in said heating zone (4) when said working fluid (in liquid state), saturating and wetting said capillary structure, is forced to vaporize continuously from said menisci into said vaporization zone (5). The continuous vaporization of said liquid causes a continuous liquid deficiency, and deepens the liquid menisci in the region. The tendency for the system to return to the equilibrium forces the liquid menisci to return to the equilibrium (or initial) height and curvature, thus creating the capillary suction pressure—which is the driving force drawing the condensate into the capillary (or porous) structure in said cooling zone (8) and returning said condensate to the heating zone (4) through larger, straight capillary passages provided in the recycling zone (9). The condensation of vapor at the inside surface of said capillary (or porous) structure in said cooling zone (8) is facilitated by the concave surface of the menisci of the liquid wetting the region—an effect well-known as 'capillary condensation'. Since the vapor pressure with the concave surface is less, and therefore natural evaporation (whose rate is controlled by the diffusion-step) is normally inhibited. On the contrary, this low vapor pressure and the capillary suction pressure described above can promote rapid forced-vaporization (whose rate is controlled by the vaporization-step, but not by the diffusion of vapor), as has been reported by many workers and experimentally confirmed by the present inventor also—a phenomenon often called 'Capillary Suction Vaporization', or 'Capillary Suction Boiling'. It is these two desirable phenomena that facilitate the rapid vaporization in the heating zone (4) and at the same time, the rapid condensation in the cooling zone (8) inside the vapor-power plant provided by the present invention.

As may be obvious from the above description, the working fluid (in liquid state) inside said vapor engine provided by the present invention may flow from the cooling zone (8) to the heating zone (4), executing steadily and continuously the cycle as far as said capillary suction pressure in the heating zone (4) is maintained higher than the pressure of vapor in the adjacent vaporization zone (5) while said vaporization and said condensation are continued. To assure this, the cooling and condensation taking place in the cooling zone (8) and the condensation zone (7) must be as rapid as the heating in the heating zone (4) plus the vaporization (and super-heating, if provided) in the vaporization zone (5). Consider a situation in which more heat is added to the engine than it can be removed or lost to the surroundings. In such a situation, it may appear that the pressure inside the engine will rise very quickly; and the liquid temperature may also increase rapidly as a result. It may appear also that the rise in the liquid temperature will lower the surface tension of the working liquid and of the consequent capillary suction pressure, resulting in the eventual closing of the pressure differential between the heating zone (4) and the vaporization zone (5)—which is essential to the operation of this invention. But, the established facts indicated otherwise. It is important to note that for any liquids, both its surface tension and latent heat of vaporization decrease with rises in the liquid temperature at the same rate; this is because the surface tension is nothing more than a consequence of the liquid cohesive force, which determines almost solely its latent heat of vaporization. (For example, the latent heat of vaporization of 1 lb of water at the temperatures of 32° F., 480° F., 650° F., 700° F., 705° F. and 705.34° F. are: 1075.1 Btu, 739.8 Btu, 422.7 Btu, 171.7 Btu, 75.6 Btu, and zero Btu, respectively.) This is to say that a liquid can be vaporized more readily at a higher temperature or its vapor at a higher temperature can be condensed into liquid more readily than at a lower temperature; and with the same cooling rate, more vapor can be condensed into liquid in equilibrium with the vapor at a higher temperature. Furthermore, a rise in the liquid temperature, while tending to lower the rate of heat-input due to the resultant decrease in the driving force—the temperature differential between the heat source and the liquid—, will, at the same time, increase the rate of cooling proportionately as a result of the increase in the driving force—the temperature differential between the liquid and the cooling medium. Because of the above described facts which tend to moderate any changes in the operating temperature and pressure resulted from sudden increases in the heat-input rate, the cooling and the controlling of the vapor-power plant provided by the present invention present negligible (or no) problems, provided that an adequate cooling system is provided to handle the heat to be rejected under the normal operating conditions. This unique characteristic of the present invention—self-moderating the operating temperature and pressure—may not be found in any vapor-power plants known.

The basic principles necessary in designing the vapor-power plant according to the present invention and to determine the ideal operating conditions for the same may be described as follows, without giving unnecessary details which are out of the scope of this disclosure.

In designing for the heating zone (4), the heat added, $Q_{add}$, may be related to the over-all heat transfer coefficient, U, the heat transfer area, A, and the temperature differential, $\Delta T$, between the heat source and the working fluid (in liquid state) saturating the capillary (or porous) structure by the following relationship:

$$Q_{add} = U \cdot A \cdot \Delta T \quad (1)$$

where U accounts for the overall effects of radiation, conduction and convection taking place in said heating zone, and must be determined experimentally for given design, material and working fluid; A accounts for the external surface area (of said heating zone) being exposed to said heat source if $Q_{add}$ is added externally. With the internal heating using a rotating drum having a heating jacket, Equation 1 may also be used; the actual values of U, A and $\Delta T$ for said drum must be determined separately. In either case, the thermal conductivity of the material of construction, the thermal conductivities of the working fluid and of the heating medium, the geometry of the designs, the hydrodynamic properties and surface property of the working fluid will determine the overall heat transfer coefficient, U. For a given value of U, the value of $Q_{add}$ may be varied by simply varying the value of A in its design or of $\Delta T$ through changes in the temperature of the heating medium. In designing for the vaporization (and super-heating, if the internal heating by a rotating-drum is employed) zone (5), the total heat added, $(Q_{add})_{total}$ may be related to the enthalpy of the working liquid (in liquid state), $H_{w1}$ and that of the vapor before expansion, $H_1$ as follows:

$$(Q_{add})_{total}=(H_1-H_{w1})-q_v \quad (2)$$

where $q_v$ is the heat lost to the surroundings from the vaporization zone (5).

The work done by expansion, $w_e$ is:

$$w_e=H_1-H_2 \quad (3)$$

where $H_2$ is the enthalpy of vapor after isentropic expansion, assuming no heat lost or added during the expansion in the expansion zone (6). The thermodynamic efficiency, $\eta_{Th}$ is:

$$\eta_{Th}=\frac{H_1-H_2}{(Q_{add})_{total}} \quad (4)$$

Figure 2:
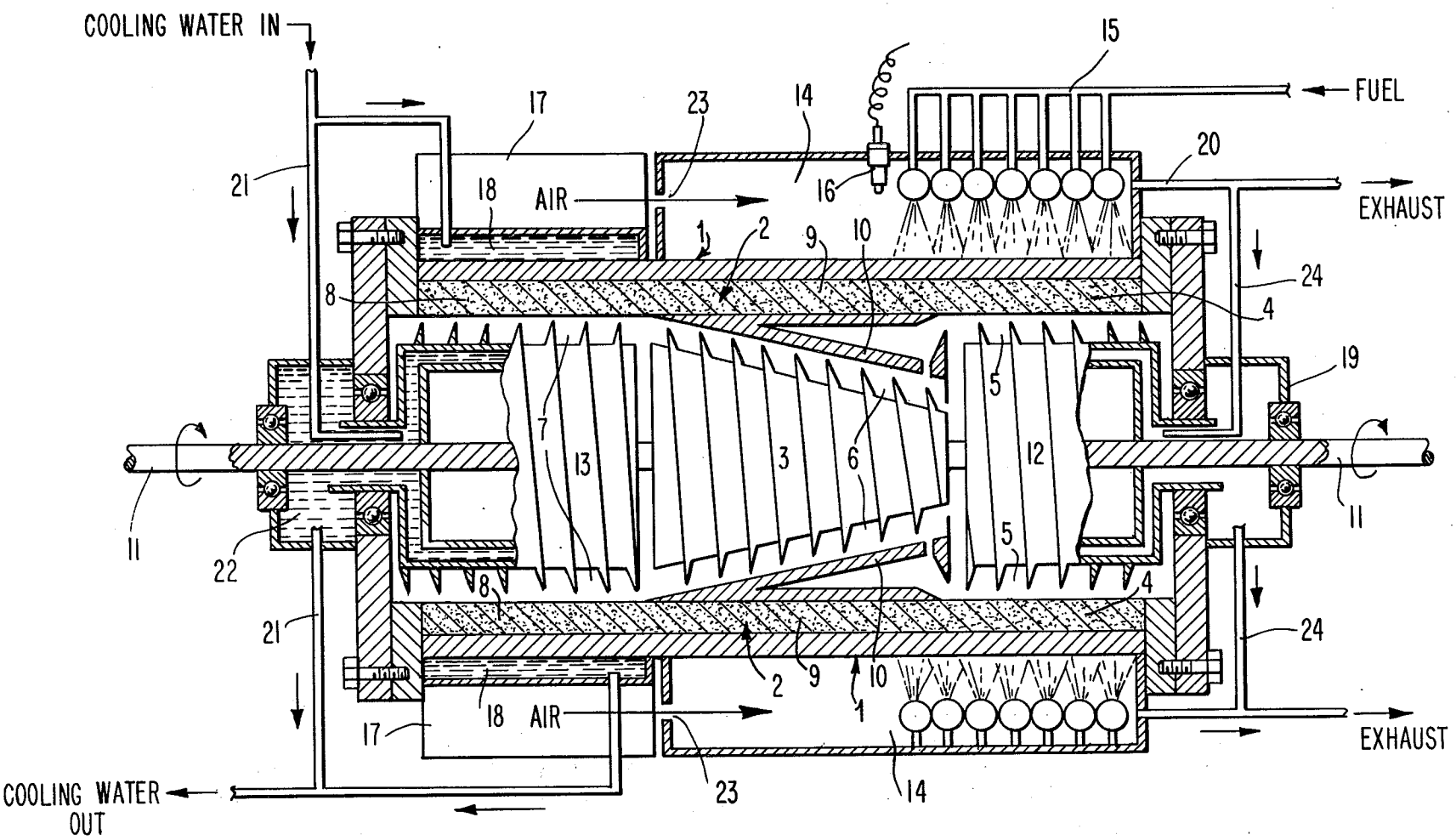

The indicated efficiency, $\eta_I$ of the vapor turbine (3) is the ratio of the shaft-work done, $w_s$ to the isentropic enthalpy drop accompanying expansion of vapor from the inlet state to the exhaust pressure. Thus, $$\eta_I=\frac{w_s}{H_1-H_2}=\eta_O/\eta_M$$

or $$w_s=H_1-H_2'=\eta_I w_e$$

where $\eta_O$ is the overall efficiency and $\eta_M$ the mechanical efficiency, and $H_2'$ is the actual enthalpy of exhaust. Heat-loss from the expanding vapor to the surroundings must be prevented as much as possible. Said turbine must operate under the conditions that the exhaust vapor does not contain more than 5 to 10% of liquid droplets, which can erode the nozzles and blades badly at high velocities. To prevent heat loss, the compressed vapor may be passed through the inner space (or pocket) of the turbine-housing (10) connecting to the nozzles, as shown in FIG. 2-Experimental Vapor-power Plant. The principles needed for designing high-efficiency vapor turbines are well-understood by the workers in the field; therefore they will not be described herein.

The total heat rejected, $(Q_{rej})_{total}$ including any heat lost to the surroundings is related to the enthalpy of the condensate, $H_{w2}$ as:

$$(Q_{rej})_{total}=H_2-H_{w2} \quad (5)$$

With negligible heat-loss, $(Q_{rej})_{total}$ is equal to the latent heat of condensation, $\lambda_2$.

$$(Q_{rej})_{total}=\lambda_2 \quad (6)$$

If the heat-loss, $q_v$ from the vaporization zone (5) is also negligible, and $T_1$ is approximately equal to $T_2$ as may be applicable under many operating conditions, then $H_{w1}=H_{w2}$ and $\lambda_1=\lambda_2$. For this ideal case, $$(Q_{add})_{total}=(H_1-H_2)+(H_2-H_{w2})=w_e+(Q_{rej})_{total}=w_e+\lambda \quad (7)$$

In designing for the cooling zone (8) and for the condensation zone (7), a relationship similar to Equation 1 may be used; and the same consideration and procedures may be employed for this purpose.

In designing for the recycling zone (9) and for the two adjacent zones for the purpose of recycling the condensate to the heating zone (4) from the cooling zone (8), the average velocity of the working fluid (in liquid state), $\bar{v}$ per capillary may be related to said capillary suction pressure, $\Delta P$ and the geometry of the capillaries (or pores) as:

$$\bar{v}=\frac{D^2 g_c \Delta P}{32\,\mu L} \quad (8)$$

where D is the diameter of the capillaries (or pores), $\mu$ the viscosity of the working fluid (in liquid state), L the length of the capillaries, and $g_c$ the conversion factor, (mass)(length)/(g force)(sq. time). From the value of $\bar{v}$ and the number of capillaries, the total volumetric flow rate of the liquid can be determined. For a given $\bar{v}$ value applicable to a given capillary size (diameter and length) and a given working fluid, the total volumetric flow rate of the working fluid may be varied by simply varying the number of capillaries or the cross-sectional area of the capillary (or porous) structure. The total volumetric flow rate determined by this method corresponds to the maximum flow rate obtainable. The capillary suction pressure, $\Delta P$ is determined by the surface tension of the liquid and the radius of the capillaries by the following well-known relationship.

$$\Delta P=2\sigma\cos\theta/r \quad (9)$$

where $\sigma$ is the surface tension, r the radius of the capillaries, and $\theta$ the contact angle by the liquid, which should be negligible for a liquid completely wetting the capillary wall. For examples, $\Delta P$ of water wetting a capillary of one micron diameter at 212° F. is about 0.99 atm; $\Delta P$ of mercury wetting a capillary of the same size at 482° F. is about 17.80 atm; and that of sodium at 208° F. is about 19.42 atm. From Equation 9, it is clear that the flow of the working fluid (in liquid state) through said capillary (or porous) structure can be promoted by employing extremely small capillaries (or pores) near the surface of the heating zone (4) and by using large straight capillaries (or pores) in the interior of said capillary (or pore) structure and in the entire recycling zone (9). By cross-plotting the capillary suction pressures, $\Delta P$ that can be generated by a given working fluid in a given said capillary (or pore) structure and the saturated vapor pressures of said working fluid against temperatures, the pressure and the corresponding temperature at which both curves intercept each other is the pressure equal for the two. Therefore, this is the maximum operatable pressure of said vapor-power plant using said working fluid. For example, for the system of water and capillaries of one micron diameter, this maximum operatable pressure is 57.5 psia at 515° F.

From the working concept and principles described above, it may be said that the vapor-power plant provided by the present invention may have a number of unique and desirable features. These features are: (1) extremely simple design and construction, (2) flexible and stable operation over a wide range of the operating temperature and pressure, (3) high thermodynamic and overall efficiency due to the simple design and negligible heat loss, (4) practically trouble-free operation since it has a single basic moving-part, (5) very quiet, (6) compact, (7) no limit in size and capacity, (8) unlimited shape and design possible, (9) rapid heating and cooling give rapid response, (10) multiple fuel capability, (11) multiple working-fluid capability, (12) completely self-contained and portable, (13) nonpolluting, (14) total lack of vibration, (15) practically no limit in turbine-speed, (16) no oil needed, (17) no cold starting problems, (18) extremely long service-life due to its mechanical simplicity, (19) light-weight and high power to weight ratio, (20) adoptable to multi-stage expansions and to multicycle using multiple working fluids, (21) compatible with most existing transmission systems, (22) negligible maintenance required, (23) almost unaffected by gravity force, (24) very low cost of construction, etc. Most of the above described features have been experimentally confirmed directly or indirectly by the present inventor through a long, extensive investigation.

EXAMPLES

Numerous experimental systems representing either the entirety or a part (or parts) of the vapor-power plant provided by the present invention have been investigated by varying design, scheme, material, working fluid, operating conditions and technique. Some examples are described and discussed in the following.

Referring to FIG. 2—Schematic Representation of the Experimental Vapor-power Plant—(vertical cross-sectional view)—a stainless steel pipe and plates are employed to construct the outer shell (1) of the vapor engine; the inside wall of the engine is made of porous nickel (2) having nonuniform pore-size and pore-orientation to allow rapid flow of the working fluid, water; the average size of the pores in the heating zone (4) is about two microns and that in the recycling zone (9) is about 100 microns; the turbine (3) is made of a stainless steel wheel mounted with forward-curved rotary blades on its periphery and rotates on the shaft (11); the turbine-housing (10) made of stainless steel allows the passage of the compressed vapor through its hollow space (or pocket) to the nozzles which are supported by said turbine-housing (10) around said turbine (3) and directed at said blades tangentially to the periphery of the turbine-wheel, permitting the expansion of vapor in the expansion zone (6). A heating-drum (12) with a heating jacket constructed along its periphery and short, forward-curved thrust blades mounted on the outside surface of said heating jacket rotates on said shaft (11). The heating-drum (12) can be disassembled from the shaft (11). The vaporization and super-heating of the vapor are carried out in the vaporization zone (5). The hot gases from the combustion chamber (14) may be circulated through said heating jacket of said drum (12) through the pipe-line (24) and the gas-pocket (19). Inside the combustion chamber (14), there are several ring-shaped burners having nozzles directed from the inside periphery of each of them, which are mounted circularly around the outer shell of the vapor engine to provide uniform heating. The combustion is controlled through the fuel-line (15) and the ignitor (16); the exhaust gas is led out through the exhaust-pipe (20). For internal cooling, a rotating drum (13) with a cooling jacket constructed along its periphery and short backward-curved thrust blades mounted on the outside surface of said cooling jacket is employed. It rotates on the same shaft (11). The cooling and condensation of vapor occur on both the inside surface of the cooling zone (8) and the outside surface of said drum (13). A cooling water is circulated through the pipe (21) and the water reservoir (22). The cooling zone (8) is externally cooled by a cooling jacket (18) constructed on the outer shell of said vapor engine on the side opposite to the heating zone. If necessary, a radiator may be employed to recool the used cooling water; a fan is run by the shaft (11) to provide air-cooling, and supply air into the combustion chamber (14) through the air-inlet (23), passing the spaces between the extended surfaces (17), which are mounted radially on the periphery of said cooling jacket (18) to facilitate the air-cooling. Common bearing/washer/seal assemblies are employed to facilitate tight but frictionless sealing between the rotating shaft (11) and the side walls of the vapor engine to prevent leakage of the working fluid and of the heat-transferring media, as shown in FIG. 2. Distilled water was employed as the working fluid. It is important that the working fluid (in liquid state) be completely saturating and wetting the entire capillary structure (2), but no excess amount of the liquid is present inside the engine; the engine must be completely sealed while in operation. For many experimental runs carried out, simple electrical heating was used instead of the combustion of a fuel gas as depicted in FIG. 2.

The functional effects of the major parts of the vapor engine are described below. When heat is added externally, the water saturating the porous nickel is vaporized into the vaporization zone (5); the vapor is then super-heated by the heating drum (12) and thrusted toward the inner space (or pocket) of the turbine-housing (10), where it is further compressed before expanding itself through the nozzles against the blades of the turbine (3). As said turbine continues to spin on the shaft (11), the vapor generated in the heating zone (4) repeats the same processes of super-heating, accelerating, compressing, and expanding. The exhaust vapor is thrusted toward the surface of the porous nickel in the cooling zone (8) due to its momentum from the expansion zone (6) and also due to the reversal of its direction by the short, backward-curved thrust blades of the cooling drum (13), which also promotes the cooling and condensation of said vapor and casts tangentially the condensate droplets from its outer surface against the surface of said porous nickel in the cooling zone (8). All the condensate formed in the condensation zone (7) is then drawn into said porous-nickel structure and returned to the heating zone (4) through the large capillaries making up the recycling zone (9). As long as the heating and the cooling continue the vapor engine continues to repeat the cycle steadily and effortlessly. Not once, the vapor engine has stalled by itself while the heating and the cooling were continued. Many experimental runs were made employing various modifications in design and various operating conditions. For each run, the response and the steadiness of the vapor engine were observed, and both thermodynamic and overall efficiencies determined. A few examples are given in the following.

EXAMPLE 1

The vapor engine was tested with neither the heating drum (12) nor the cooling drum (13). The response to sudden changes in the heat input rate was fair; and the speed of turbine (r.p.m.) and the torque of the shaft (11) were measured. The engine runs extremely smoothly between zero and several thousand r.p.m. in a temperature range between 250°–420° F. and a pressure range between 3.0–33.0 psia. The thermodynamic efficiency, $\eta_{Th}$ was determined by employing $H_1$ and $H_2$ calculated using the temperatures and pressures measured in the heating zone (5) and in the cooling zone (7) separately and the value of $Q_{add}$ obtained by the energy balances made. The temperatures were measured using bi-metallic thermometers, and the pressures were measured with pressure gauges; both inserted into the side walls of the vapor engine. It was found to be about 65%, indicating there was an appreciable amount of heat lost to the surroundings. The overall efficiency, $\eta_O$, was determined by employing the actual shaft work, $w_s$ measured (through the torque and the r.p.m. of the shaft) and the enthalpy drop due to isentropic expansion, $H_1$–$H_2$. The value of $\eta_O$ determined by this method was about 66%. It was not able to separate $\eta_O$ into the turbine efficiency, $\eta_I$ and the mechanical efficiency, $\eta_M$ since the actual enthalpy, $H_2'$ of the exhaust could not be determined. The actual shaftwork increased as much as 10 times due to the increase in the operating pressure in the range mentioned above.

EXAMPLE 2

The vapor engine was run with both rotating drums but neither internal heating nor internal cooling was employed. The response to sudden changes in the heat input was very good as compared to Example 1; it runs extremely smoothly between zero and about ten thousand r.p.m. in a temperature range between 260–400° F. and a pressure range between 3.5–26.0 psia. The actual shaft-work (horse-power) was increased by as much as 7.5 times by the increases in the operating temperature and pressure in these ranges. The thermodynamic efficiency, $\eta_{Th}$ was about 48%, indicating more heat was lost than in Example 1; this excessive heat loss may be attributed partly to the heat lost to the two drums and the fittings associated to them. The two rotating drums, even without internal heating and cooling, seemed to contribute to the better responsiveness of the vapor engine to sudden changes in the heat input rate. It is believed that the vaporization in the vaporization zone (5) was promoted by the blades of the rotating drum (12), without heating, which reversed the velocity of the vapor from the surface of said porous nickel as soon as it was generated. Similarly, it appeared that the rotating drum (13), without cooling, facilitated the condensation of vapor by reversing its velocity toward the surface of the cooling zone (8). The overall efficiency, $\eta_O$ was determined to be about 65%—an improvement over Example 1—indicating a substantial increase in the turbine efficiency, especially if one considers the increased mechanical friction in this run due to the introduction of the two rotating drums.

EXAMPLE 3

Both the internal heating by the heating drum (12) and the internal cooling by the cooling drum (13) were employed. The vapor engine was very responsive to sudden changes in the heat-input rate; and it ran extremely smoothly in a temperature range between 250–425° F. and a pressure range between 2.9–33.0 psia. The thermodynamic efficiency, $\eta_{Th}$ was 67%, and the overall efficiency, $\eta_O$ was 69%. This indicates that the internal heating and cooling are more efficient than external heating and cooling. The actual shaft-work (horse-power) increased as much as 12 times when the operating pressure increased from 2.9 psia to 33.0 psia. The substantial increase in the overall efficiency may be attributed to the introduction of the internal heating and internal cooling by the two rotating drums (12 and 13).

Through an extensive study, the present inventor found that while the operating temperature and pressure are increased, more working fluid is vaporized into the vapor phase and as a result, less liquid remains in the capillary (or pore) structure. But, this fact does not create any noticeable effects upon the performance (such as power, response and smoothness) of the vapor engine. This may be due to the fact that the depletion of the working fluid (in liquid state) in the porous structure is compensated by the thermal expansion of the liquid; and as a result, the porous structure suffers no depletion of the working fluid.

It was found that the maximum operatable pressure for water as the working fluid in the experimental system used is about 36.0 psia which corresponds to 430° F., which is the maximum operatable temperature at which the pressure of the saturated vapor is equal to the capillary pressure of the saturated water in the porous nickel employed. The values are several percent lower than the theoretical values mentioned above.

When a sudden rise in the liquid temperature is caused by a sudden, rapid increase in the heat addition, the liquid may boil below the menisci; but in a closed system the boiling will stop quickly as the pressure of vapor generated increases rapidly unless the rapid heat addition were continued without a stepped-up cooling. If a rapid heating is matched by a rapid cooling, boiling should not cause any serious problems to the operation of the vapor engine other than lowering in the vapor quality due to liquid entrainment. When the operating temperature exceeded the maximum operatable, a decrease or halt in heating would enable the vapor engine to continue its operation while the temperature and pressure inside the engine will fall rapidly; no difficulties other than a drop in the power output should be experienced by this procedure.

The practicality of various liquids, molten metals and salts as the working fluid was studied. It has become evident that many non-corrosive liquids, molten metals and salts may be employed as the working fluids. The desirability of a liquid or molten solid as the working fluid in the vapor-power plant provided by the present invention may be estimated approximately by considering the acceleration of the vapor engine, A which appears to obey the following rule:

$$A \propto \frac{kM\sigma}{\lambda\mu} \tag{10}$$

where k is the thermal conductivity, M the molecular weight, $\sigma$ the surface tension, $\mu$ the viscosity, and $\lambda$ the latent heat of vaporization of the working fluid, all measured at the operating temperature. Furthermore, the melting point, the boiling point and the maximum operating temperature and pressure ranges desirable are also the important factors to be taken into consideration. Among metals, mercury Hg may be rated best;

and sodium Na, potassium K, etc. are among the second best. Among inorganic liquids, water $H_2O$ seems to be the best; then hydrazine $N_2H_4$, hydrogen peroxide $H_2O_2$, etc. may also be considered. There are many organic liquids which are considered to be desirable as the working fluid in the vapor engine provided by this invention; for example, formamid $CH_3NO$ seems to be desirable. Among the important factors included in Equation 10, the surface tension of the working fluid is most important since it defines the upper limit of the operating pressure when it is employed in the vapor engine provided by the present invention. The higher the operating pressure, the higher the operating temperature. In addition to the wettability, the melting point of the material used to make the porous structure is an important factor also. For example, aluminum (porous) is a good conductive metal having a high melting point; and therefore it is recommendable for use with liquid metal or molten metals. The orientation of the vapor engine provided by this invention may have a minor effect on its performance although the heating zone of the engine may be preferably placed at the lowest point in order to have a more rapid downward liquid-flow within the porous structure.

It is obvious from the above description and example illustration that a completely self-contained vapor-power plant requiring a single basic moving-part—means for converting the work of expansion by the working fluid to the mechanical work—can be built and will work within an enclosed space (or chamber), by imposing and maintaining the force differential between the working fluid (in liquid state) flowing through said capillary (or porous) structure, under the influence of said capillary pressure created at the menisci of said working fluid being vaporized from a predetermined part of said capillary (or porous) structure, and said working fluid (in vapor state) flowing and experiencing expansion and condensation outside said capillary (or porous) structure; said vaporization being caused by the continuous addition of heat into said enclosed space (or chamber) at a predetermined location and said condensation being caused by the continuous removal of heat from said enclosed space (or chamber) at another predetermined location.

It will be understood that the present invention includes all the vapor-power plants designed, and work according to the working concept as described above; said vapor-power plant, according to the present invention, requires a single basic moving part, and therefore is extremely simple in design, practically trouble-free and highly efficient in operation; it is quiet and non-polluting to its environment. The design (geometry, scheme, etc.) of the present invention may be varied widely; its size may be unlimited; its capacity may be unaffected by its size; its orientation, while in operation, relative to a gravity field affects very little its performance; its working fluid may be chosen by the procedure recommended herein, from a wide variety of substances including inorganic and organic liquids, liquid and molten metals, molten salts, etc.; said capillary (or porous) structure may be constructed using various conductive and wettable (by the working fluid) materials, pore sizes, pore-size distribution, geometry, etc.; heat may be added into and removed from said enclosed space (or chamber) of the engine at separate, predetermined locations in various ways using various heat sources and transferring media; the optimum operating conditions including the temperatures and pressures inside the engine, the temperatures of heating and cooling medias, turbine-velocity, etc. depend mainly on the working fluid, the design, construction, use, and environment of the vapor-power plant.

Having thus described my invention of what I claim as new and desire to secure by Letters Patent is:

1. A vapor-power plant comprising: a body; wall means defining an enclosed space within said body, and across which heat and work flow; a porous structure adjoining the inside surface of at least a portion of said wall means and containing continuous capillary passages, said continuous capillary passages being open at least in part to said enclosed space in at least two separated areas; a vaporizable working fluid wetting and saturating said porous structure; means for introducing heat to heat and vaporize said working fluid in the part of said porous structure near one of said separated areas; means for expanding the vapor formed from said working fluid; means for converting the work of expansion done by said vapor into mechanical work; means for removing said mechanical work; means for removing heat to cool and condense said working fluid vapor in the part of said porous structure near another of said separated areas; internal heat exchange means located inside said enclosed space, for exchanging heat with said working fluid; said porous structure being constructed so that when said liquid working fluid is vaporized in part of said porous structure, the capillary suction pressures created at the smaller menisci of said liquid working fluid being vaporized cause said working fluid to flow to said part of said porous structure where said vaporization takes place from said part of said porous structure where said condensate is formed through the larger capillary passages connecting said separated areas of said porous structure; said means for expanding said vapor and said means for converting said work of expansion into said mechanical work being located in said enclosed space relative to the location of said porous structure so that said working fluid may undergo said processes of vaporizing, expanding, condensing and returning itself to execute a complete cycle involving said processes in a closed system defined within said body.

2. A vapor-power plant according to claim 1 wherein said internal heat exchange means comprises rotatable drum means mounted on a common shaft with said converting means and on at least one side of said converting means, said drum means being hollow and being adapted for an internal flow of heat transfer medium.

3. A vapor-power plant according to claim 2 wherein said drum means is provided on its exterior cylindrical surface with short projections adapted to controlling the flow of vapor.

* * * * *